United States Patent [19]

Evans

[11] Patent Number: 5,005,398

[45] Date of Patent: Apr. 9, 1991

[54] HEMMING MACHINE

[75] Inventor: Owen C. Evans, Birmingham, Mich.

[73] Assignee: Craftmation, Inc., Troy, Mich.

[21] Appl. No.: 531,920

[22] Filed: Jun. 1, 1990

[51] Int. Cl.[5] ..... B21J 9/18

[52] U.S. Cl. ..... 72/450; 29/243.58; 100/271; 100/280

[58] Field of Search ..... 72/381, 380, 323, 450, 72/451, 407; 29/243.58; 100/280, 271, 281

[56] References Cited

U.S. PATENT DOCUMENTS 4,346,579 8/1982 Takatsu ..... 72/450
4,706,489 11/1987 Dacey, Jr. ..... 72/450

FOREIGN PATENT DOCUMENTS 1155414 10/1963 Fed. Rep. of Germany .
686651 7/1930 France ..... 72/323
200229 12/1965 Sweden ..... 72/381
958671 8/1960 United Kingdom .
958672 5/1964 United Kingdom .
1075663 7/1967 United Kingdom .

*Primary Examiner*—David Jones
*Attorney, Agent, or Firm*—Lyon & Delevie

[57] ABSTRACT

A machine for hemming a panel having a fixed die with an edge contour complementary to an edge of the panel, a movable die head having prehemming and hemming dies thereon with edge contours, respectively, complementary to the edge contour of said panel, a single fluid actuator, and a cam controlled linkage for effecting both vertical and lateral movement of both said hemming die and said prehemming die relative to said fixed die upon operation of said actuator.

6 Claims, 4 Drawing Sheets

HEMMING MACHINE

BACKGROUND OF THE INVENTION

Hemming machines are utilized to reentrantly fold an edge portion of a primary panel against itself or against a secondary panel thereby to reinforce the primary panel edge and present a smooth finished edge surface. Initially, the edge of the primary panel is folded in the stamping process to an angle of approximately 90° relative to the surface thereof. The folded edge of the panel accommodates superposition of a secondary panel in juxtaposed relation thereto. Thereafter, the upstanding edge flange on the primary panel is reentrantly folded or "hemmed" to finish the edge and to secure the secondary panel, if used.

In order to condition the upstanding flange on a panel for hemming, it is necessary to reduce the angle of the upstanding flange from 90° relative to the panel to an angle short of its final folded position, for example 45°, but sufficient to insure proper folding of the flange when impacted by the hemming die. This is known in the art as "prehemming".

To accomplish the aforesaid prehemming, prior art hemming operations required two machines, one to effect a first or "prehemming" fold and a second machine to accomplish the final hem. Transfer of the workpiece between two work stations was required. Moreover, hemming machines heretofore known and used utilized a plurality of hydraulic cylinders to effect the required opening, closing and lateral movements of the hemming die. Use of hydraulic cylinders necessitated the use of hydraulic pumps which are characterized by excessive noise and fluid leakage. Moreover, control of the hydraulic cylinders requires relatively complex, inflexible valving.

SUMMARY OF THE INVENTION

The hemming machine of the present invention solves the aforementioned problems in that it effects both prehemming and final hemming in a single machine and in a single cycle of operation. The machine comprises a plurality of like gates which are operable pneumatically and are capable of relatively simple electronic control. Easy access to the pneumatic cylinders is made possible by their mounting on individual gates. The gates can be operated individually or can be synchronized to hem all edges of the panel simultaneously. A unique mechanical toggle action linkage in combination with cam controlled movement of the hemming dies minimizes tolerance deviations in both the prehemming and the final hemming phases of the hemming cycle.

DETAILED DESCRIPTION OF THE PREFERRED EMBODIMENT OF THE INVENTION

Figure 1:
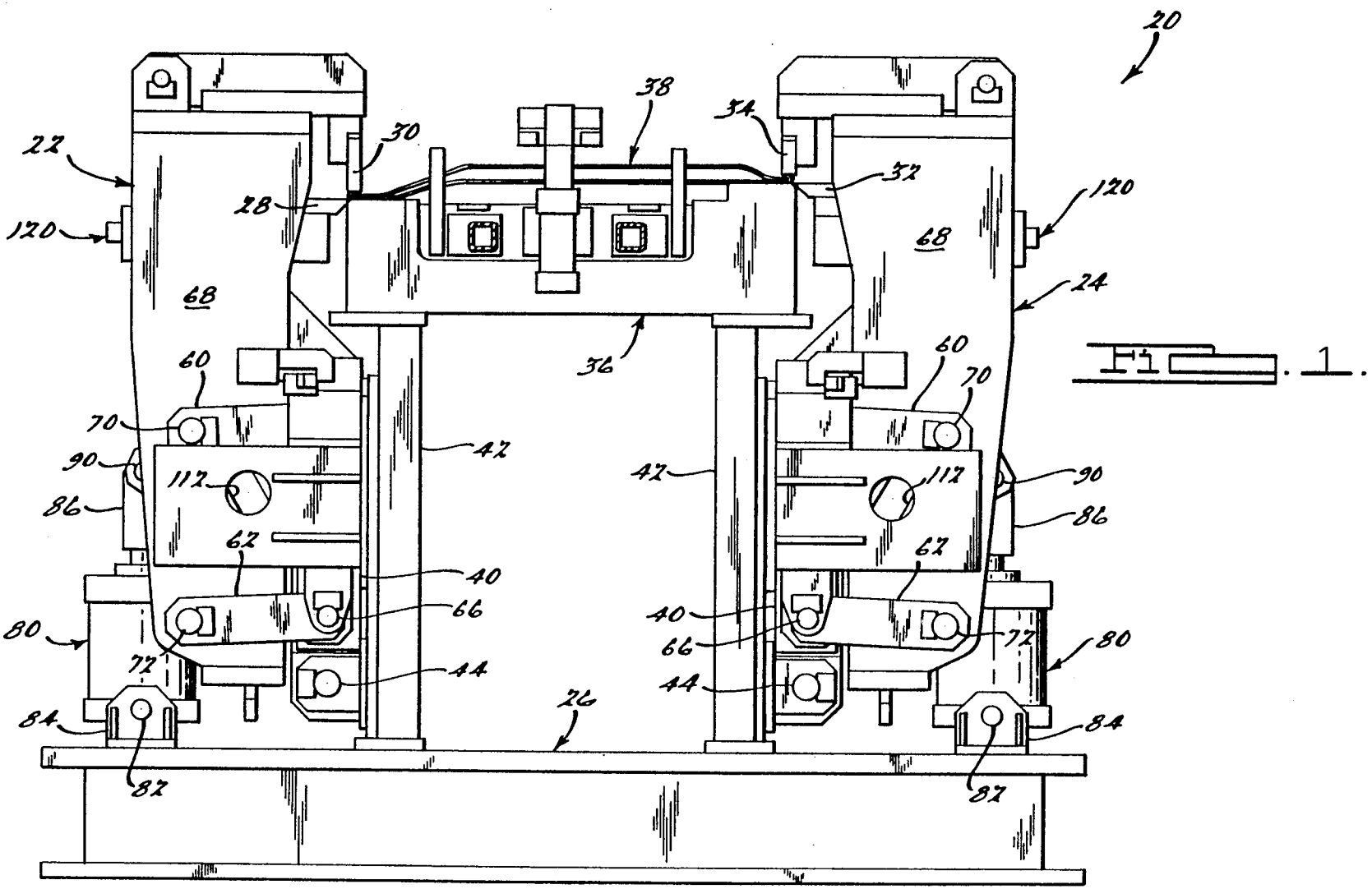
FIG. 1 is a side-elevational view of a hemming machine in accordance with a constructed embodiment of the instant invention comprising a pair of opposed gates.

As seen in FIG. 1 of the drawings, a hemming machine 20 comprises a pair of gates 22 and 24 that are mounted on a common base 26. The gates 22 and 24 are similar in construction except for the contour of a pair of a movable prehemming and hemming dies 28–30 and 32–34 thereon, respectively. The dies 28–30 and 30–32 cooperate with a fixed die 36, to effect hemming of an edge flange 37 of a panel 38, as will be described. Since the gates 22 and 24 are similar in construction, only the gate 24 will be described in detail it being understood that the description thereof is applicable to the gate 22 except for the configuration of the prehemming and hemming dies 28 and 30 thereof, respectively.

Figure 2:
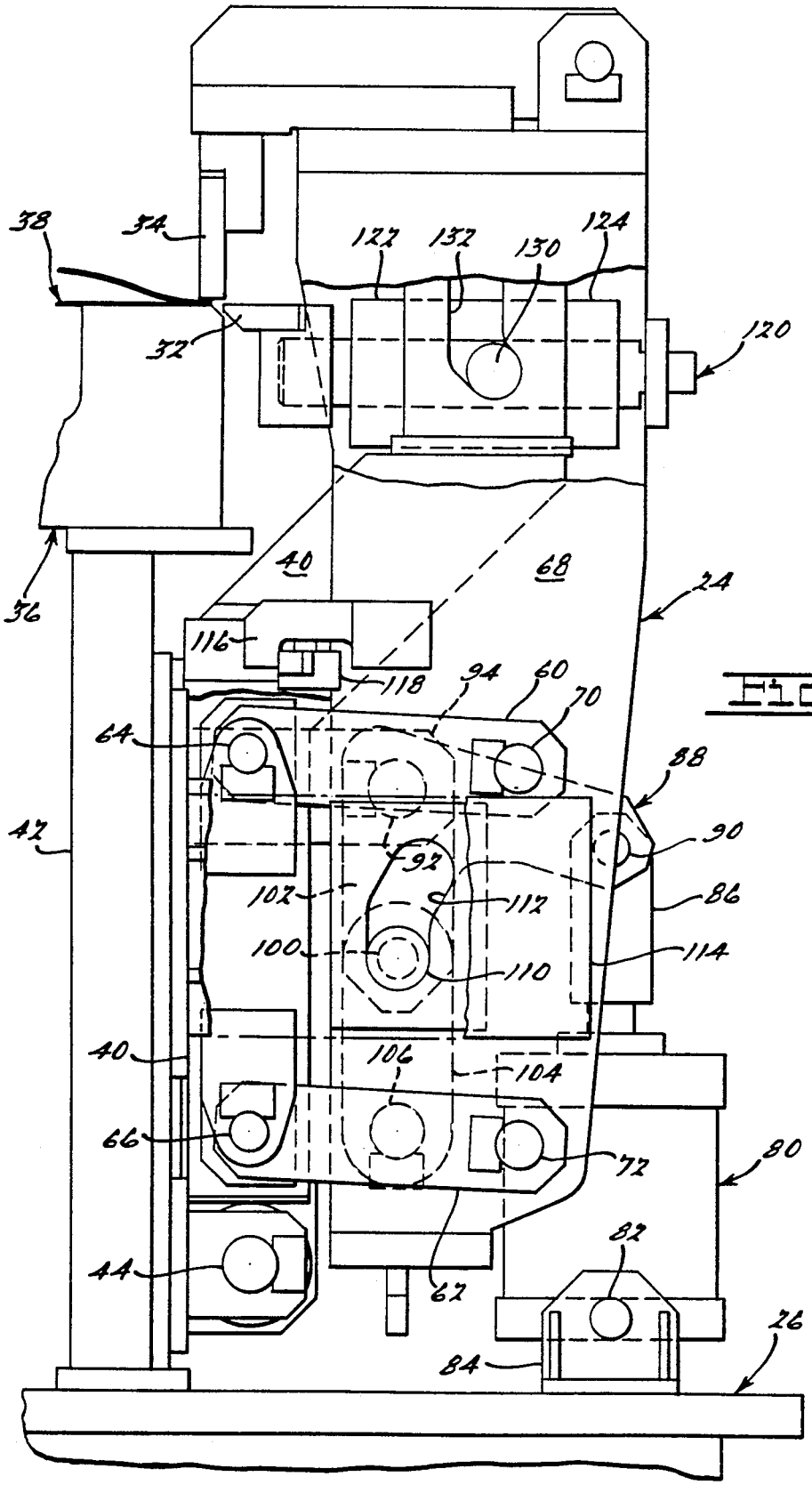
FIG. 2 is a fragmentary view, partially in section, of one gate of the machine of FIG. 1 at the end of the hemming stroke.

As best seen in FIG. 2 of the drawing, the gate 24 comprises an upstanding arm 40 that extends generally parallel to and is pivotally mounted on an upstanding stanchion 42 on the base 26 by a pin 44. The stanchion 42 also supports the fixed die 36 which has edge contours complementary to the contours of the panel 38 being hemmed.

In accordance with one feature of the instant invention, a pair of links 60 and 62 are pivoted to the arm 40 by pins 64 and 66, respectively. The opposite ends of the links 60 and 62 are pinned to an upstanding movable die head 68 by pins 70 and 72, respectively. Thus, the arm 40, links 60 and 62 and movable die head 68 function as a collapsible parallelogram, the links of which are connected to one another by the pins 64, 66, 70 and 72.

Movement of the movable die head 68 relative to the arm 40 is controlled by a pneumatic actuator 80 which is pivoted on a pin 82 journaled in a mounting bracket 84 on the base 26. A piston rod 86 of the pneumatic actuator 80 is pivotally secured to one end 87 of a bell crank 88 by a pin 90. The bell crank 88 is pivotally supported by a pin 92 that is supported by a bracket 94 secured to the upstanding stanchion 42. A pin 100 joins an opposite end 102 of the bell crank 88 to a lower link 104 which, in turn, is pivotally secured to the movable die head 68 by a pin 106.

Figure 3:
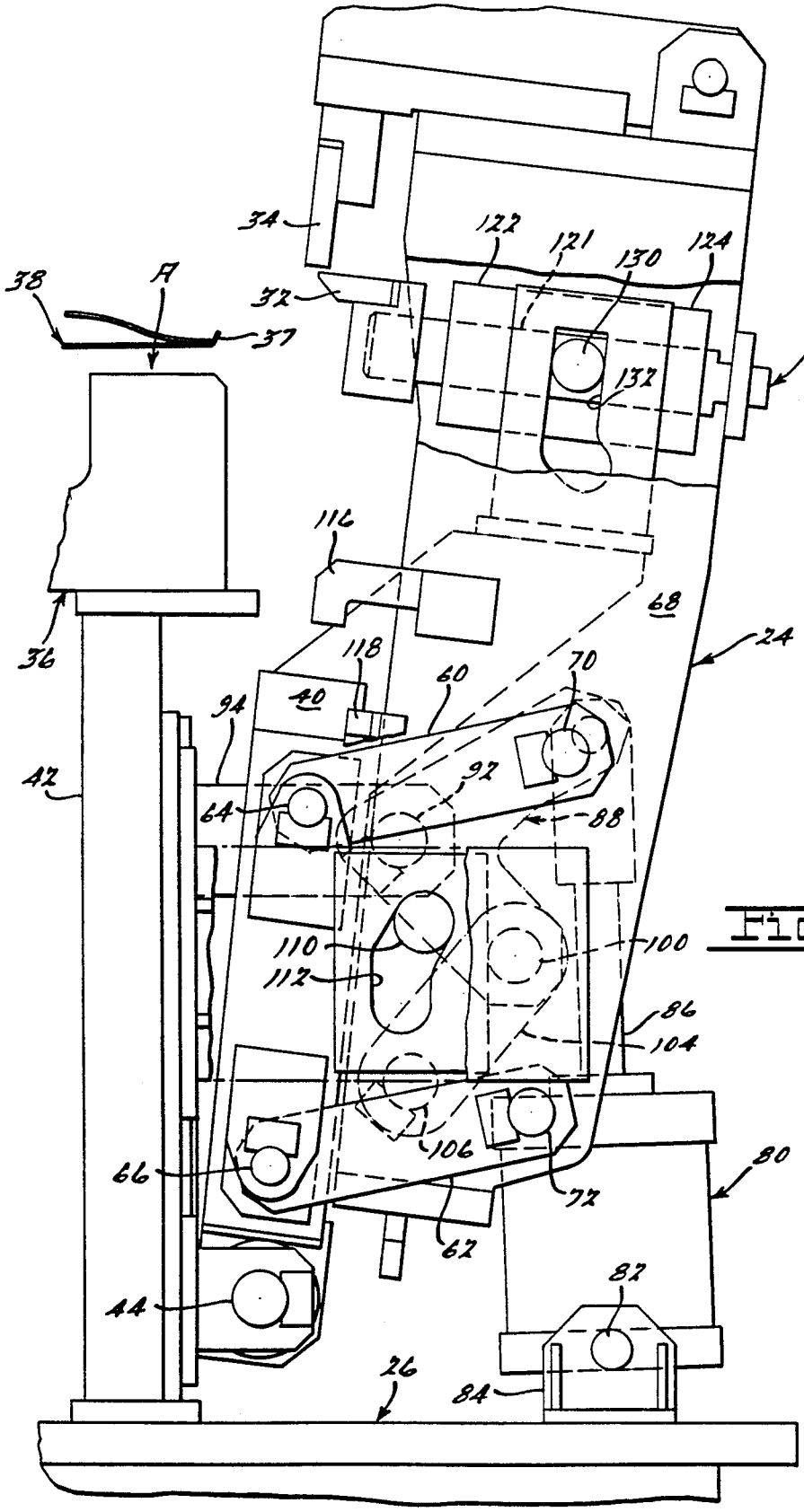
FIG. 3 is a view showing the gate of FIG. 2 an elevated and laterally retracted condition for the acceptance of a panel to be hemmed.

Energization of the actuator 80 and extension of the rod 86 thereof effects rotation of the bell crank 88 about its support pin 92 to the position shown in FIG. 3, wherein the pin 100, link 104, pin 106 and movable die head 68 are elevated to the position shown in FIG. 3.

In accordance with another feature of the instant invention, upward movement of the movable die head 68 is accompanied by lateral movement thereof. Such lateral movement is controlled by a circular cam or pin 110 which is carried by the movable die head 68 and which moves in a cam slot 112 in a bracket 114 secured to the stanchion 42. Upward movement of the movable die head 68 effects laterally outward rotation thereof and its supporting arm 40, as the cam 110 moves in the cam slot 112. Thus, extension of the actuator rod 86 effects both elevation and rotation of the movable die head 68 to permit transfer, as shown by the arrow "A" in FIG. 3, of the workpiece 38 onto the fixed die 36. On retraction of the actuator rod 86 and downward movement of the die head 68, a locking finger 116 on the die head 68 engages a lock block 118 on the arm 40 to positively control relative movement between the die head 68 and arm 40 during the last increment of the hemming cycle, as will be described.

In accordance with yet another feature, the hemming machine 20 of the instant invention affects prehemming of the workpiece 38. Prehemming is required since the edge flange 39 of the panel 38 is folded upwardly at an angle of approximately 90° from the surface of the panel in the stamping operation. Accordingly, the movable die head 68 supports a prehemming die carrier 120 that is carried upwardly and laterally relative to the arm 40 by the die head 68 as it moves upwardly and laterally. The prehemming die carrier 120 comprises a shaft 121 that is journaled in a pair of bearing blocks 122 and 124 on the die head 68. The shaft 121 carries a transverse pin or cam 130 which is slidable in a cam slot 132 in the arm 40. Thus, as the die head 68 moves upwardly relative to the arm 40, the prehemming die carrier 120 is moved laterally of the movable die head 68 as controlled by the slope of the lower end of the cam slot 132, thereby to move the prehemming die 32 relative to the hemming die 34, as will be described in greater detail.

As best seen in FIGS. 3 through 12 of the drawings, a cycle of operation of the heming machine 20 starts from the condition shown in FIG. 3 of the drawings, namely, the open condition for the acceptance of a panel 38 to be hemmed. In this condition, the rod 86 of the pneumatic actuator 88 is in the fully extended condition and the bell crank 88 is fully rotated counterclockwise, as seen in the drawings, to an end position carrying the pin 100, link 104, pin 106 and die head 68 to their uppermost condition relative to the arm 40. After positioning of the workpiece 38 on the fixed die 36, movement of the actuator rod 86 in the retract direction affects downward movement of the die head 68 relative to the fixed die 36 through the aforesaid linkage.

Figure 4:
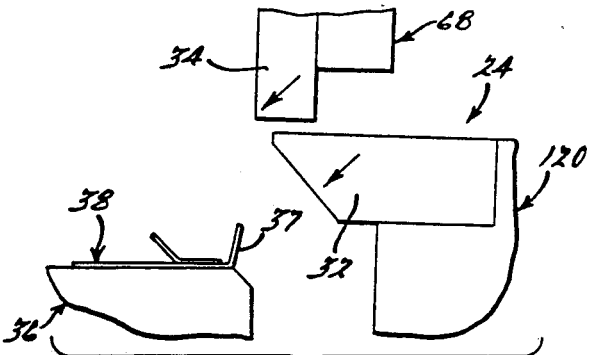
FIGS. 4–12 illustrate the sequence of movement of the movable prehemming and hemming dies of the hemming machine through the hemming cycle.

FIG. 4 is a fragmentary view illustrating the position of the die head 68, the hemming die 34 thereon, the prehemming die carrier 120, and the prehemming die 32 mounted thereon after the first increment of movement from the full open condition illustrated in FIG. 3.

Figure 5:
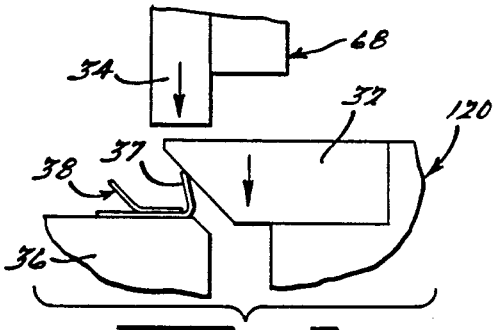

As seen in FIG. 5, as the head 68 moves downwardly, it carries the prehemming die carrier 120 and prehemming die 32 downwardly and counterclockwise whereby the prehemming die 32 engages the upstanding edge flange 37 on the workpiece 38.

Figure 6:
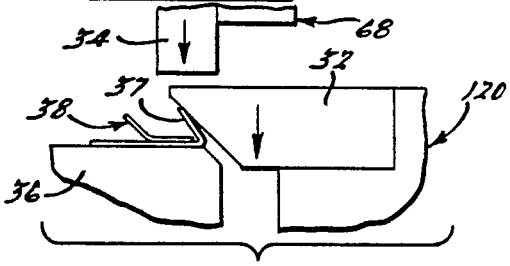

As seen in FIG. 6, as the movable die head 68 continues to move downwardly, the prehemming die 32 continues to bias the flange 37 on the workpiece 38 counterclockwise to the position shown in FIG. 6.

Figure 7:
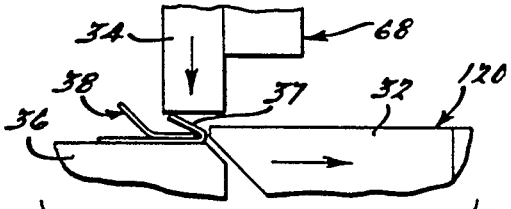

As seen in FIG. 7 of the drawings, the prehemming die 32 is retracted to the right relative to the fixed die 34 due to movement of the pin 130 on the prehemming die carrier 120 within the slot 132 of the arm 40. This movement of the prehemming die 32 clears the movable die 34 for engagement with the prehemmed flange 37 so as to bias the flange 37 downwardly to the position shown in FIG. 8 of the drawings.

Figure 8:
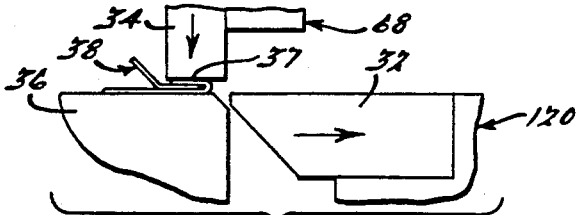

As seen in FIGS. 2 and 8 of the drawings, full retraction of the rod 86 of the actuator 80 has carried the movable die head 68 and hemming die 34 downwardly relative to the fixed die 36 to complete hemming of the flange 37 of the workpiece 38.

Figure 9:
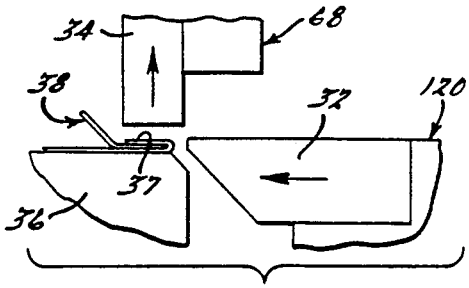

As seen in FIG. 9 of the drawings, initial upward movement of the rod 86 of the actuator 80 effects upward movement of the die head 68 and hemming die 34.

Figure 10:
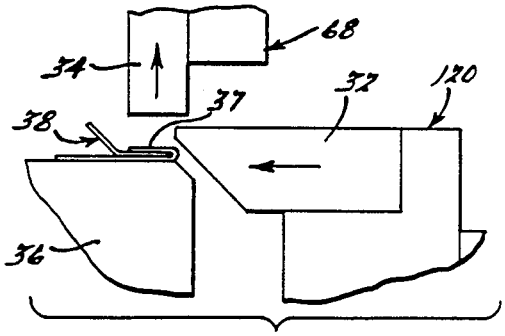

As seen in FIG. 10 of the drawing, the aforesaid movement of the die head 68 also effects lateral movement of the pin 120 in the cam slot 132 of the arm 40 which initiates movement of the prehemming die 32 to the left relative to the hemming die 34.

Figure 11:
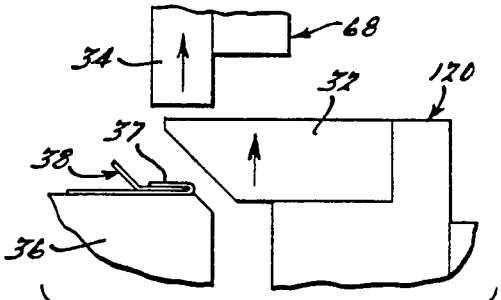

As seen in FIG. 11, the prehemming die 32 has fully moved to the left relative to the hemming die 34 due to the fact that the pin 120 has reached the vertical portion of the cam slot 132. Thereafter, the pin 130 moves vertically in the slot 132 in the arm 40 with no further affect on the prehemming die 32.

Figure 12:
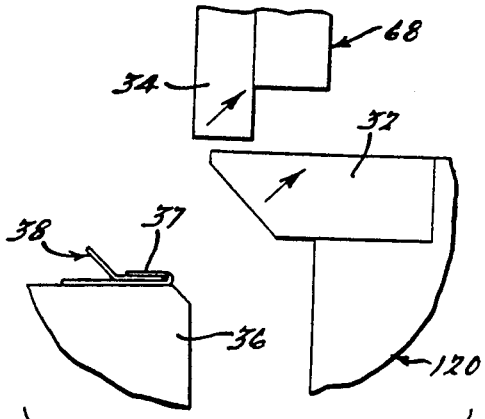

FIG. 12 shows the die head 68 approaching its uppermost condition with the hemming die 34 and prehemming die 32 substantially fully elevated and laterally retracted to condition the hemmed workpiece 38 for vertical removal from the fixed die 36. It is to be noted that the gates 22 and 24 may be synchronized to hem all edges of the part 38 simultaneously.

From the foregoing description it should be apparent that the hemming machine 20 of the instant invention exhibits high speed, efficient hemming and offers the user a clean, quiet working environment since it operates with a cycle time of approximately seven seconds on 60–85 PSI air pressure. All cylinders of the machine 20 are mounted on an outer surface of the gates thereof for easy access. The pneumatic controls of the machine are economical and durable.

While the preferred embodiment of the invention has been disclosed, it should be appreciated that the invention is susceptible of modification without departing from the scope of the following claims.

I claim:

1. A machine for hemming the edge of a relatively flat panel comprising a base;

a fixed die supported by said base in vertically spaced relation thereto and having a contour complementary to an edge of said panel;

an arm pivoted on said base and extending generally vertically therefrom;

a die head having a hemming die thereon with an edge contour complementary to the edge contour of said panel;

a pair of parallel links spaced from one another and having one end pivotally mounted on said arm, respectively, and an opposite end pivotally mounted on said die head, respectively, so as to support said die head for movement relative to said arm;

a first cam surface on said base extending at an angle to the vertical;

a cam follower on said die head and engagable with said cam surface to effect lateral movement of said die head relative to the vertical; and an extendable fluid actuator having one end secured to said base and an opposite end controlling movement of said die head, energization of said fluid actuator effecting both vertical and lateral movement of said die head and hemming die relative to said fixed die.

2. A machine for hemming the edge of a relatively flat panel comprising a base;

a fixed die on said base having a contour complementary to an edge of said panel;

an upstanding arm having a lower end pivoted on said base;

a die head;

means for mounting said die head on said arm for both vertical and horizontal movement toward and away from said fixed die;

a prehemming die carried by said die head having a contour complementary to the edge contour of said panel and movable horizontally toward said fixed die to effect prehemming of the edge portion of said panel;

a hemming die on said die head having a contour complementary to the edge contour of said panel and movable vertically toward said fixed die to effect hemming of the edge portion of said panel, and actuator means for moving said die head relative to said fixed die.

3. The hemming machine of claim 2 comprising a first cam surface on said base extending at an angle to the vertical; and a cam follower on said die head engagable with said cam first surface to effect horizontal movement of said die head concomitantly with vertical movement thereof.

4. A hemming machine in accordance with claim 2 wherein said actuator means comprises a fluid actuator having one end secured to said base and an opposite end controlling movement of said die head, energization of said fluid actuator effecting both vertical and horizontal movement of said die head relative to said fixed die.

5. A hemming machine in accordance with claim 2 wherein said mounting means comprises a pair of spaced links connected at one end to said arm, respectively, and at the other end to said die head respectively, whereby said arm, links and die head define a collapsible parallelogram.

6. A machine for hemming the edge of a relatively flat panel comprising a base;

a fixed die on said base having a contour complementary to an edge of said panel;

an upstanding arm having a lower end pivoted on said base;

a die head;

means for mounting said die head on said arm for both vertical and horizontal movement toward and away from said fixed die;

a prehemming die carried by said die head having a contour complementary to the edge contour of said panel and movable horizontally toward said fixed die to effect prehemming of the edge portion of said panel;

a hemming die on said die head having a contour complementary to the edge contour of said panel and movable vertically toward said fixed die to effect hemming of the edge portion of said panel;

actuator means for moving said die head relative to said fixed die;

a first cam surface on said base extending at an angle to the vertical;

a cam follower on said die head engagable with said cam first surface to effect horizontal movement of said die head concomitantly with vertical movement thereof;

a second cam surface secured to said base; and a cam follower on said prehemming die engagable with said second cam surface for effecting movement of said prehemming die relative to said hemming die.

* * * * *